US005918104A

United States Patent [19]

Balliett et al.

[11] Patent Number: 5,918,104

[45] Date of Patent: Jun. 29, 1999

[54] PRODUCTION OF TANTALUM-TUNGSTEN ALLOYS PRODUCTION BY POWDER METALLURGY

[75] Inventors: Robert W. Balliett, Westborough; Trung Luong, Worcester, both of Mass.

[73] Assignee: H.C. Starck, Inc., Newton, Mass.

[21] Appl. No.: 08/997,907

[22] Filed: Dec. 24, 1997

[51] Int. Cl.[6] ..... C22C 1/04; C22C 27/02

[52] U.S. Cl. ..... 419/46; 419/38; 75/246

[58] Field of Search ..... 419/38, 46; 75/245

[56] References Cited

U.S. PATENT DOCUMENTS 4,859,257 8/1989 Bates et al. ..... 148/422

5,171,379 12/1992 Kumar et al. ..... 148/422

5,242,481 9/1993 Kumar ..... 75/364

5,580,516 12/1996 Kumar ..... 419/1

*Primary Examiner*—Daniel J. Jenkins

*Attorney, Agent, or Firm*—Perkins, Smith & Cohen, LLP

[57] ABSTRACT

Powder metallurgy production of Ta10W alloy affording properties comparable to melt derived Ta10W, but at higher yields and lower costs, is enabled by blending component powders of minus 325 mesh and sintering at 2,400° C. in three sinter steps and utilizing a slow ramp up in the first sinter step and cold isostatic pressing prior to the first sinter step and isostatic press densification in conjunction with at least the first sinter step.

3 Claims, No Drawings

PRODUCTION OF TANTALUM-TUNGSTEN ALLOYS PRODUCTION BY POWDER METALLURGY

CROSS REFERENCE TO RELATED APPLICATIONS

Our application for T222 PRODUCTION BY POWDER METALLURGY is filed of even date herewith and disclosure thereof is incorporated herein by reference as though set forth at length herein.

BACKGROUND OF THE INVENTION

The present invention relates to production of tantalum-tungsten alloys of 7.5 to 15 w/o alloy, a well known high strength-at-high temperature alloy used in furnace heating elements and shields, high strength, corrosion resistant springs, getters in halogen lamps and other applications.

State of the art processes for making ta10W involve complex melt cycles.

It is the object of the invention to provide a tantalum-tungsten alloy product and process of making it characterized by higher yields and lower cost while substantially matching properties of the state of the art products.

SUMMARY OF THE INVENTION

The objects are achieved by a powder metallurgy process using very fine Ta, W powders and a long sinter cycle, preferrably at least 10 hours at over 2,100° C. preferrably at 2,400° C. for over half such period. It has been found that through this process that, surprisingly, powder metallurgy can be successfully implemented to produce a Ta10W alloy which not only eliminates the costly melt steps, but also affords a higher yield.

Other objects, features and advantages will be apparent from the following detailed description of preferred embodiments:

DETAILED DESCRIPTION OF PREFERRED EMBODIMENTS

The powder metallurgy Ta10W alloy produced pursuant to the present invention has a fine grain structure despite the extended sinter time, is uniformly alloyed and stress free. The extrusion and forging breakdown steps are not needed. The product as produced by the present process can be cold worked.

Practice of the invention is illustrated by the following non-limiting examples:

Example 1

A powder was made up of:

45 w/o-325 J powder 45 w/o-325 RC powder

10% W powder where J powder is a sodium derived powder and RC powder is an electron beam melted hydride/dehydride powder. All % figures are by weight. The powders were rough mixed and then blended for homogeneous distribution in a V-blender for 15 minutes, cold isostatically pressed at 50 ksi and then sintered with two 0.9 in.×9 in. bars in three steps as follows:

First Sinter 1 hour at 1,800° C.

1 hour at 1,900° C.

1 hour at 2,000° C.

3 hours at 2,400° C.

Density press at 90 ksi

Second Sinter

3½ hours at 2,400° C.

Density press at 90 ksi

Third Sinter 5 hours at 2,400° C.

The bars were rolled to 0.081 in. diameter wire in the following schedule:

a. Roll to 0.620" (53% reduction in area of RA)

b. Anneal at 2,500° F. for 1.5 hours c. Roll to 420" (59% RA)

d. Anneal at 2.500° F. for 1.5 hours e. Roll to 0.270" (59% RA)

f. Anneal at 2,500° F. for 1.5 hours g. Roll to 0.147" (70% RA)

h. Anneal at 2.500° F. for 1.5 hours i. Roll to 0.082" (76% RA)

j. Final anneal at 2,500° F. for 1.5 hours

After each rolling step cracked corners, ends or surface portions were removed. The overall yield was 50%, highly favorable compared to melt derived products. Most yield loss was due to corner cracking in the first yield sequence.

A chemical analysis of the product's bar end showed 84 ppm oxygen, 5 ppm nitrogen, 5 ppm carbon. Brinnell hardness was measured (at room temperature) at 117.7 Brinnell hardness, ultimate tensile strength was $108.1\times10^3$ psi, yield strength $90.6\times10^3$ psi, % elongation at 25% and grain size ASTM 10.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Process for production of tantalum −10 w/o tungstun alloy comprising:

(a) provision of minus 325 mesh of component Ta, W component powders of the alloy in standard percentages;

(b) sintering the powders in a series of sintering steps, each comprising at least 3 hours at 2,400° C. or higher.

2. Process in accordance with claim 1 wherein the sintering steps are preceded by cold isostatic pressing and at least a first of the steps comprises isostatic pressing densification conducted thereby.

3. Process in accordance with claim 2 wherein the sintering steps are used as follows:

First Sinter 1 hour at 1,800° C.

1 hour at 1,900° C.

1 hour at 2,000° C.

3 hours at 2,400° C., followed by isostatic density pressing at 90 ksi

Second Sinter

3½ hours at 2,400° C., followed by isostatic density pressing at 90 ksi

Third Sinter 5 hours at 2,400° C., without pressing and the first sinter step is preceded by cold isostatic pressing at 50 ksi.

* * * * *